US009510697B2

(12) United States Patent
Wagner

(10) Patent No.: US 9,510,697 B2
(45) Date of Patent: Dec. 6, 2016

(54) COMMERCIAL SHELF PRODUCT ALIGNMENT DEVICE

(71) Applicant: David Wagner, New Castle, CO (US)

(72) Inventor: David Wagner, New Castle, CO (US)

( * ) Notice: Subject to any disclaimer, the term of this patent is extended or adjusted under 35 U.S.C. 154(b) by 0 days.

(21) Appl. No.: 14/706,769

(22) Filed: May 7, 2015

(65) Prior Publication Data

US 2016/0324339 A1 Nov. 10, 2016

(51) Int. Cl.
*F24B 15/00* (2006.01)
*A47F 13/06* (2006.01)
*B25J 1/04* (2006.01)

(52) U.S. Cl.
CPC . *A47F 13/06* (2013.01); *B25J 1/04* (2013.01)

(58) Field of Classification Search
CPC ..... F24B 15/10; B65G 7/12; A01K 97/14; A47G 21/06; B25J 1/04; A47F 13/06
USPC ..... 294/11, 12, 26, 209
See application file for complete search history.

(56) References Cited

U.S. PATENT DOCUMENTS 1,903,316 A * 4/1933 Ritley ..... F24B 15/10 294/11
4,955,647 A * 9/1990 Alfredson ..... F24B 15/10 294/14
6,450,557 B1 9/2002 Martinez
6,502,875 B1 * 1/2003 Berry ..... A47F 13/00 294/15
D497,086 S 10/2004 Lopes
7,131,675 B1 * 11/2006 Loucks ..... F24B 15/002 294/10
7,490,880 B1 2/2009 Matsui
D600,082 S 9/2009 Braver
8,262,147 B2 9/2012 Boyum
8,608,218 B1 * 12/2013 Marthens ..... A47F 13/08 211/59.3
D701,098 S * 3/2014 Braver ..... D8/14
2004/0100109 A1 5/2004 Johnson
2008/0173136 A1 * 7/2008 Kim ..... B67B 7/16 81/3.55
2011/0174119 A1 7/2011 Weinberg et al.

* cited by examiner

*Primary Examiner* — Stephen Vu

(57) ABSTRACT

A commercial shelf product alignment device for facilitating neat and straight alignment of commercial products on a shelf in a market includes a handle having a first end and a second end. An elongated shaft is coupled to and extends from the handle. A bend is positioned in the shaft defining a first section and a second section of the shaft. The first section defines a right angle with the second section wherein the shaft is configured for aligning products on a commercial shelf by abutting the products against the first section of the shaft.

3 Claims, 3 Drawing Sheets

COMMERCIAL SHELF PRODUCT ALIGNMENT DEVICE

BACKGROUND OF THE DISCLOSURE

Field of the Disclosure

The disclosure relates to alignment devices and more particularly pertains to a new alignment device for facilitating neat and straight alignment of commercial products on a shelf in a market.

SUMMARY OF THE DISCLOSURE

An embodiment of the disclosure meets the needs presented above by generally comprising a handle having a first end and a second end. An elongated shaft is coupled to and extends from the handle. A bend is positioned in the shaft defining a first section and a second section of the shaft. The first section defines a right angle with the second section wherein the shaft is configured for aligning products on a commercial shelf by abutting the products against the first section of the shaft.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
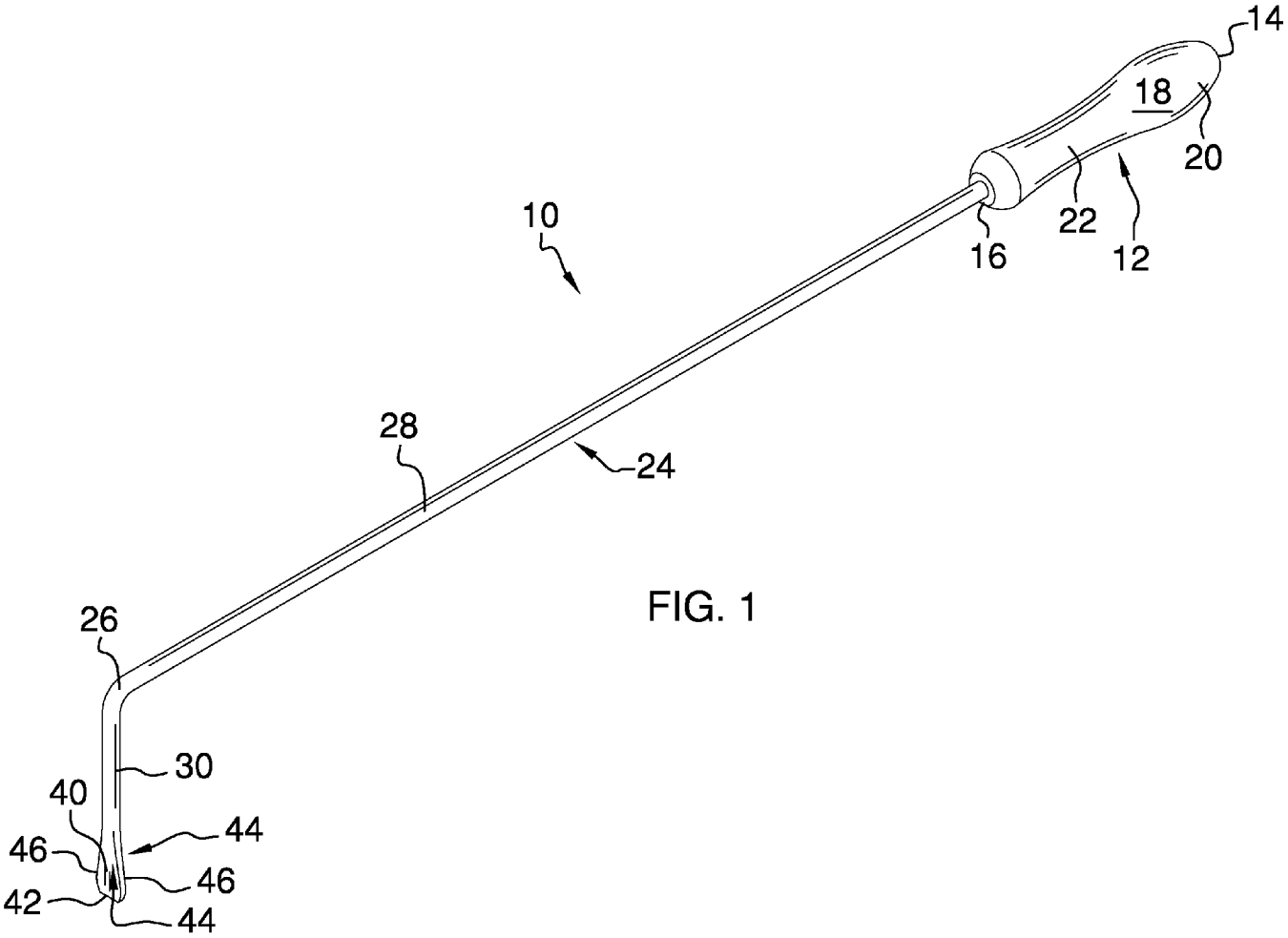
FIG. 1 is a top front side perspective view of a commercial shelf product alignment device according to an embodiment of the disclosure.
Figure 2:
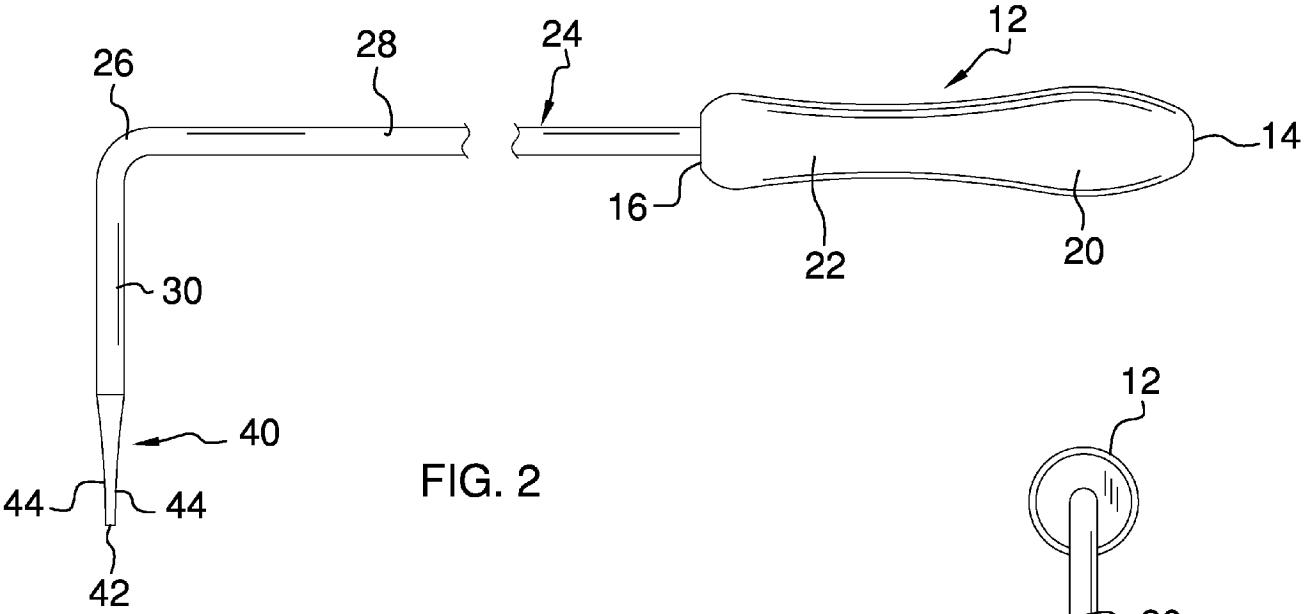
FIG. 2 is a bottom view of an embodiment of the disclosure.
Figure 3:
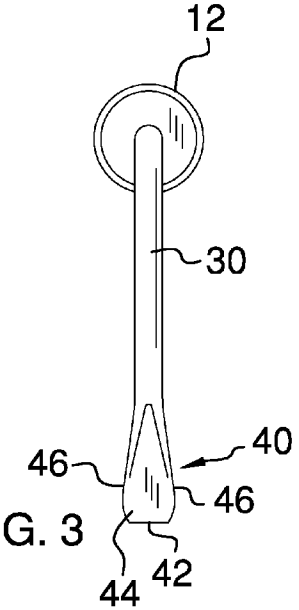
FIG. 3 is a front view of an embodiment of the disclosure.
Figure 4:
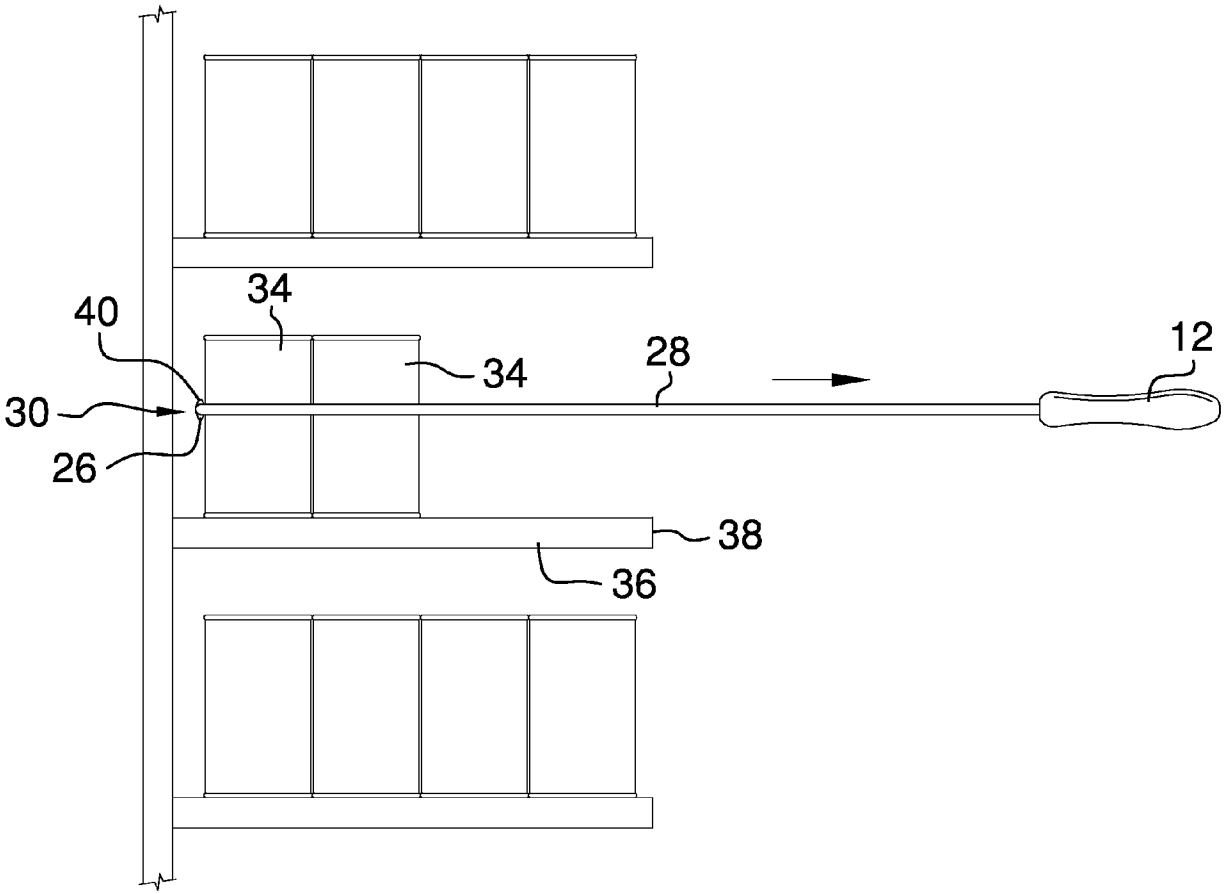
FIG. 4 is a side view of an embodiment of the disclosure in use.

With reference now to the drawings, and in particular to FIGS. 1 through 4 thereof, a new alignment device embodying the principles and concepts of an embodiment of the disclosure and generally designated by the reference numeral 10 will be described.

As best illustrated in FIGS. 1 through 4, the commercial shelf product alignment device 10 generally comprises a handle 12 having a first end 14 and a second end 16. The handle 12 is elongated between the first end 14 and the second end 16. The handle 12 may have a circular transverse cross-sectional shape along a full length of the handle 12. An outer surface 18 of the handle 12 may be smooth and curved defining a bulbous portion 20 and a neck portion 22 wherein the handle 12 is configured for being grasped comfortably by a human hand.

A shaft 24 is coupled to and extends from the second end 16 of the handle 12. The shaft 24 is elongated and thinner than the handle 12. A bend 26 is positioned in the shaft 24 defining a first section 28 of the shaft 24 extending from the handle 12 and a second section 30 of the shaft 24 extending from the bend 26 away from the handle 12. The first section 28 defines a right angle with the second section 30 wherein the shaft 24 is configured for aligning products 34 on a commercial shelf 36 by abutting the products 34 against the first section 28 of the shaft 24. The products 34 are further gatherable and urgeable towards a front 38 of the commercial shelf 36 by urging the second section 30 against a rearmost one of the products 34 and pulling on the handle 12 to move the products 34 forward towards the front 38.

A distal portion 40 of the second section 30 of the shaft 24 relative to the bend 26 is flattened extending away from the bend 26 similar to a tip of a conventional screw driver. Thus, a tip 42 of the second section 30 is configured for facilitating placement of the second section 30 behind a row of the products 34 on the commercial shelf 36 or between a desired pair of the products 34. The distal portion 40 of the second section 30 of the shaft 24 has a pair of opposite faces 44. The opposite faces 44 are flat, planar, and tapered wherein the distal portion 40 is configured for facilitating insertion of the tip 42 behind a selectable one of the products 34 on the commercial shelf 36. The distal portion 40 of the second section 30 of the shaft 24 has a pair of lateral sides 46. Each of the lateral sides 46 is convexly arcuate preventing snagging when the second section 30 is disengaged from the products 34 on the commercial shelf 36.

The first section 28 of the shaft 24 may have a length between 45 and 75 centimeters. The second section 30 of the shaft 24 may have a length between 5 and 15 centimeters. The shaft 24 may have a diameter between 0.5 and 1.0 centimeters.

In use, the device 10 is carried by a person while inspecting the positioning of the products 34 on commercial shelves 36. As needed, the shaft 24 is positioned to extend between laterally adjacent rows and the second section 30 of the shaft 24 is positioned to extend behind one of the products 34 within a row to be straightened. The handle 12 is manipulated to position the products 34 against the first section 28 to align the products 34 into a straight line. The handle 12 is pulled to move the aligned products 34 to the front 38 of the commercial shelf 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A commercial shelf product alignment device comprising:

a handle having a first end and a second end;

a shaft coupled to and extending from said handle, said shaft being elongated;

a bend positioned in said shaft defining a first section of said shaft extending from said handle and a second section of said shaft extending from said bend, said first section defining a right angle with said second section wherein said shaft is configured for aligning products on a commercial shelf by abutting the products against said first section of said shaft; and a distal portion of said second section of said shaft relative to said bend being flattened extending away from said bend wherein a tip of said second section is configured for facilitating placement of said second section behind a row of products on a commercial shelf, said distal portion of said second section of said shaft having a pair of lateral sides, each of said lateral sides being convexly arcuate.

2. The device of claim 1, further comprising said distal portion of said second section of said shaft having a pair of opposite faces, said opposite faces being tapered wherein said distal section is configured for facilitating insertion of said tip behind a selectable one of the products on the commercial shelf.

3. A commercial shelf product alignment device comprising:

a handle having a first end and a second end;

a shaft coupled to and extending from said handle, said shaft being elongated;

a bend positioned in said shaft defining a first section of said shaft extending from said handle and a second section of said shaft extending from said bend, said first section defining a right angle with said second section wherein said shaft is configured for aligning products on a commercial shelf by abutting the products against said first section of said shaft; and a distal portion of said second section of said shaft relative to said bend being flattened extending away from said bend wherein a tip of said second section is configured for facilitating placement of said second section behind a row of products on a commercial shelf, said distal portion of said second section of said shaft having a pair of opposite faces, said opposite faces being tapered wherein said distal section is configured for facilitating insertion of said tip behind a selectable one of the products on the commercial shelf, said distal portion of said second section of said shaft having a pair of lateral sides, each of said lateral sides being convexly arcuate.

* * * * *